United States Patent [19]

Crain et al.

[11] Patent Number: 4,477,718

[45] Date of Patent: Oct. 16, 1984

[54] INFRARED FURNACE WITH CONTROLLED ENVIRONMENT

[75] Inventors: Norman R. Crain, Huntington Beach; Robert P. Hardison, Tustin, both of Calif.

[73] Assignee: Radiant Technology Corporation, Cerritos, Calif.

[21] Appl. No.: 456,564

[22] Filed: Jan. 10, 1983

[51] Int. Cl.[3] ..... F27B 9/06; F27D 11/02

[52] U.S. Cl. ..... 219/388; 219/411; 219/343; 219/354

[58] Field of Search ..... 219/343, 411, 354, 405, 219/342, 531, 347, 352, 357, 400, 408, 388

[56] References Cited

U.S. PATENT DOCUMENTS

| | | | |
|---|---|---|---|
| 2,549,619 | 4/1951 | Miskella | 219/411 |
| 3,188,459 | 6/1965 | Bridwell | 219/343 |
| 3,239,651 | 3/1966 | Silberman | 219/400 |
| 3,242,314 | 3/1966 | Eckles | 219/347 |
| 3,305,680 | 2/1967 | Berkl | 219/343 |
| 3,415,503 | 12/1968 | Beck | 263/8 |
| 3,688,685 | 9/1972 | Wrench | 219/395 |
| 4,101,759 | 7/1978 | Anthony | 219/411 |

*Primary Examiner*—C. L. Albritton
*Assistant Examiner*—Teresa J. Walberg
*Attorney, Agent, or Firm*—Christie, Parker & Hale

[57] ABSTRACT

An insulated firing chamber has oppositely disposed sidewalls with a plurality of aligned pairs of holes. A plurality of infrared lamps are disposed in the chamber. The end terminals of the lamps pass through the respective pairs of holes to the exterior of the chamber. The end terminals of the lamps are enclosed by sealed compartments so the only way for gas to escape from the compartments is through the holes in the sidewalls of the firing chamber. Nonreactive gas under pressure is introduced into the compartments to induce unidirectional gas flow through the holes into the firing chambers. The gas introduced into the compartments cools the end terminals of the lamps without danger of contaminating the environment inside the firing chamber. The compartments each have an access opening, a removable hatch that engages a gasket on the compartment around the opening to seal the opening when the hatch is in place.

13 Claims, 7 Drawing Figures

ENTRANCE CHAMBER
FIRING CHAMBER
COOLING CHAMBER
EXIT CHAMBER
10
12
14
16

INFRARED FURNACE WITH CONTROLLED ENVIRONMENT

BACKGROUND OF THE INVENTION

This invention relates to infrared furnaces and, more particularly, to an infrared furnace suitable for firing electronic components in a nonreactive environment.

Application Ser. No. 306,200, filed Sept. 28, 1981, the disclosure of which is incorporated fully herein by reference, describes a method for firing thick film electronic circuits and an infrared furnace in which such method can be carried out.

In this furnace, an insulated firing chamber has oppositely disposed sidewalls with a plurality of aligned pairs of holes. Infrared lamps are installed in the chamber. The end terminals of the lamps pass through the respective hole pairs in the sidewalls of the chamber to the exterior of the chamber, so the end terminals are not exposed to the high temperature in the firing chamber. Because of the high temperatures, it is difficult to seal effectively the sidewalls where the lamps pass through the hole pairs, with the result that atmospheric air leaks into the firing chamber.

In application Ser. No. 381,901, filed May 25, 1982, the disclosure of which is incorporated fully herein by reference, the described infrared furnace is provided with a firing chamber having an elongated, tubular muffle transparent to the infrared energy. The components being fired pass through the muffle and are thus directly exposed to the short wavelength energy emitted by the infrared lamps, which lie outside the muffle. The ends of the muffle lie outside the firing chamber in sealed chambers to prevent atmospheric air from entering the muffle, while a nonreactive gas passes through the muffle to sweep away volatiles released during the firing operation. In this manner, a controlled environment can be established for the components being fired. Typically, the oxygen content in the envelope can be kept to 10 ppm or less. The presence of the envelope in the firing chamber, however, produces a reduced cross-sectional area through which the nonreactive gas can flow. This has a tendency to create turbulence in the muffle. However, turbulence is an undesirable condition because it disturbs the planned temperature profile. The reduced cross-sectional area also increases the tendency for volatiles to condense in the muffle. Finally, the walls of the muffle absorb some of the infrared energy, thereby reducing somewhat the efficienty of the heat transfer to the product being fired.

SUMMARY OF THE INVENTION

According to the invention, the entire firing chamber of an infrared furnace is sealed to establish a controlled environment without a muffle. Specifically, an insulated firing chamber has oppositely disposed sidewalls with a plurality of aligned pairs of holes and oppositely disposed top and bottom walls that together define a horizontal, elongated passage from an entrance to an exit. A conveyor passes through the passage from the entrance to the exit for continuous processing of electronic components being fired. A non-reactive gas is introduced into the passage so as to flow continuously and unidirectionally toward the entrance and exit thereof. A plurality of infrared lamps are disposed in the chamber. The end terminals of the lamps pass through the respective pairs of holes to the exterior of the chamber. The end terminals of the lamps are enclosed by sealed compartments so the only way for gas to escape from the compartments is through the holes in the sidewalls of the firing chamber. Nonreactive gas is introduced into the compartments at a slightly higher pressure than that in the passage to induce unidirectional gas flow through the holes into the firing chamber. The gas introduced into the compartments cools the end terminals of the lamps without danger of contaminating the environment inside the firing chamber.

As a feature of the invention, the compartments each have an access opening, a removable hatch that engages a gasket on the compartment around the opening to seal the opening when the hatch is in place. Removal of the hatch permits access to the lamps for replacement. The cooling effect of the nonreactive gas introduced into the compartments permits effective atmospheric sealing materials to be used for the gasket.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figures 1, 2:
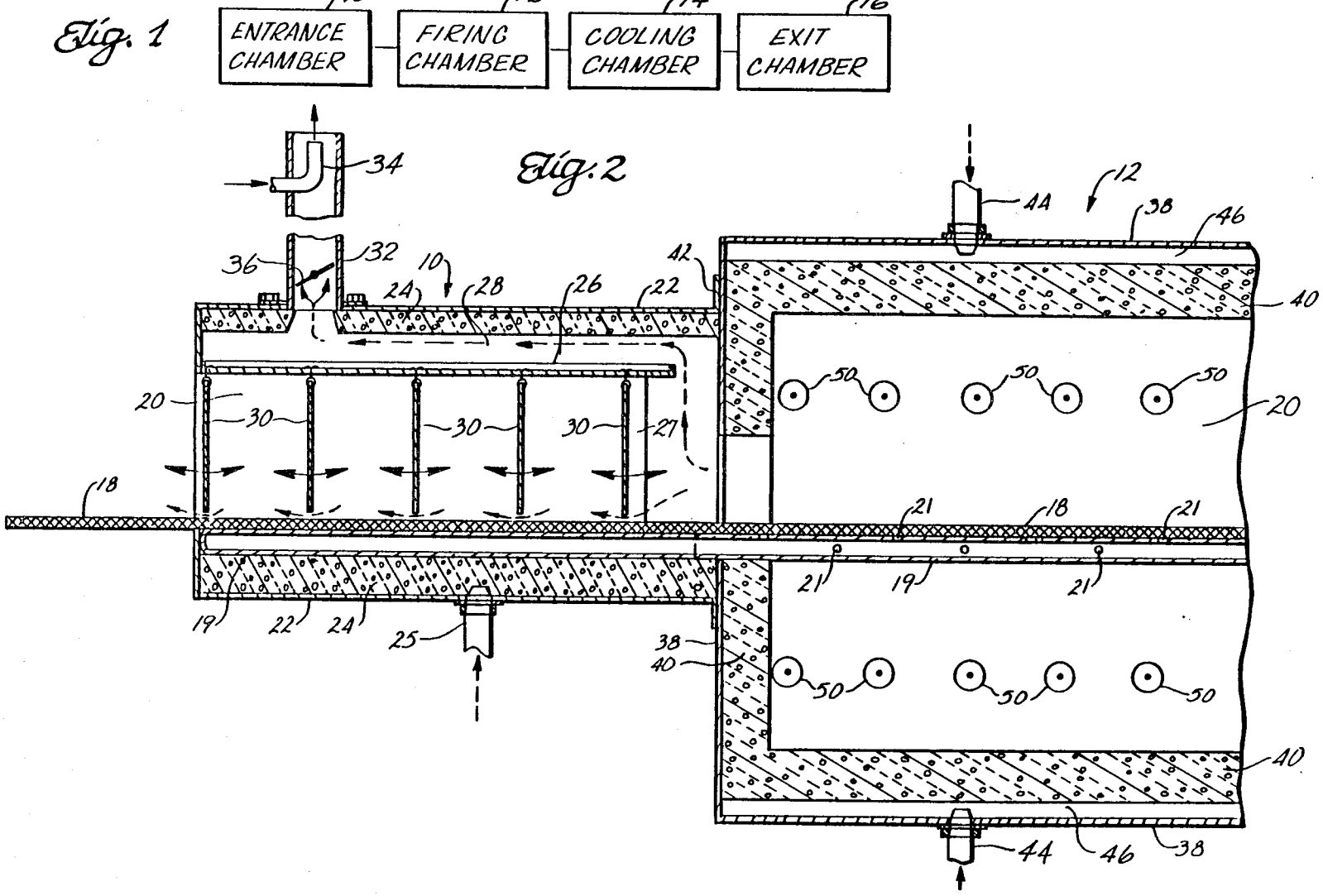
FIG. 1 is a schematic block diagram of an infrared furnace incorporating principles of the invention.
FIG. 2 is a side-sectional view of the entrance chamber and part of the firing chamber of the furnace.

With reference to FIG. 1, an infrared furnace incorporating principles of the invention comprises a plurality of interconnected chambers as follows: An entrance chamber 10 leads to a firing chamber 12, a cooling chamber 14 leads from firing chamber 12 to an exit chamber 16. As described in more detail below, a product conveyor constructed in the manner disclosed in application Ser. No. 306,200, filed Sept. 28, 1981, travels through the described chambers to permit electronic components or other items to be processed therein. The disclosure of application Ser. No. 306,200 is incorporated fully herein by reference.

Entrance chamber 10 and part of the interior of firing chamber 12 are shown in FIG. 2. A porous, endless conveyor belt 18 travels through a horizontally, elongated passage 20 in the furnace from left to right. A plurality of hollow rods 19 underly conveyor belt 18 throughout all the chambers of the furnace so as to provide support thereto. A portion of one or more of rods 19 within firing chamber 12 has holes 21 to provide communication between the interior of rods 19 and the exterior thereof. The sidewalls and top and bottom walls of entrance chamber 10 comprise a nonporous outer cover 22 and a porous heat insulative inner layer 24. A horizontally extending tray 26 having vertical, upwardly extending flanges all around its periphery is downwardly spaced from layer 24 at the top of entrance chamber 10 to form a horizontally extending venting passage 28. Tray 26 is supported by downwardly extending flanges 27 welded to its side edges. Flanges 27 rest on the surface of layer 24 at the bottom of chamber 10. Products to be fired such as copper layers on thick film circuits, travel in carrier trays (not shown) through passage 20 from left to right (as viewed in FIG. 2) on conveyor belt 18. Partitions 30 pivotally mounted on the bottom of tray 26 serve to impede the flow of gas through passage 20 between firing chamber 12 and the exterior of the furnace. As a carrier tray passes under a partition 30, it contacts the partition and pivots it in a counterclockwise direction, as viewed in FIG. 2. Alternatively, stationary partitions having a clearance with respect to the carrier trays could be provided. Near the end of entrance chamber 10, a vertical, upwardly extending exhaust duct 32 communicates with passage 28. A venturi jet 34 is disposed in duct 32. As shown, gas is fed to jet 34 to create a vacuum that draws gas out of passage 28 up through duct 32 to the exterior of the furnace. Alternatively, a blower could be provided for this purpose. One or more dampers 36 serve to control the flow rate of exhaust gas passing through duct 32. Tray 26 extends horizontally across the full width of entrance chamber 10 under duct 32 to catch volatiles that may condense in passage 28. As shown, tray 26 also extends the full length of chamber 10 except for a small space adjacent to firing chamber 12, where volatile-removing, nonreactive gas leaving firing chamber 12 enters passage 28. Tray 26 prevents condensed volatiles from dropping onto the items being fired. A nonreactive gas under pressure is supplied through a fitting 25 to layer 24 at the bottom of entrance chamber 10. This layer 24 has a series of channels (not shown) to facilitate gas distribution to all parts thereof. The nonreactive gas seeps through the pores of layer 24 to provide a low-velocity, nonreactive, super-atmospheric environment in passage 20. Gas thus flows slowly but continuously and unidirectionally toward exhaust duct 32 and to a lesser extent to the exterior of the furnace through passage 20, thereby preventing gas flow from the exterior of the furnace through passage 20 to firing chamber 12. This eliminates the possibility of contamination by atmospheric air through entrance chamber 10.

The sidewalls, end walls, and top and bottom walls of firing chamber 12 comprise a non-porous, outer cover 38 and a porous, heat-insulative inner layer 40.

A nonreactive gas is supplied through fittings 44 at the top and bottom of firing chamber 12 for seepage through layers 40. At the top and bottom of firing chamber 12, layers 40 are spaced from outer cover 38 to form plenum chambers 46 that facilitate gas distribution throughout such layers. Layers 40 in the side and end walls have a series of channels (not shown) to facilitate gas distribution throughout such layers. The nonreactive gas seeping into firing chamber 12 creates a relatively high-pressure, low-velocity, nonreactive gaseous environment therein. The gas sweeps away volatiles released from the products being fired to prevent condensation on the surfaces of the products. The gas flow rate into chamber 12 is such that the pressure therein is higher than that in entrance chamber 10 but not so high as to create turbulence in chamber 12. Thus, there is continuous and unidirectional flow of the non-reactive gas from firing chamber 12 to entrance chamber 10. The sidewalls of firing chamber 12 have a plurality of oppositely disposed aligned pairs of holes through which infrared lamps 50 pass. Lamps 50 are oriented transverse to the direction of travel of conveyor belt 18 in two banks, one lying above conveyor belt 18 and one lying below conveyor belt 18. The spacing between lamps 50, which is generally closer at the ends of firing chamber 12 because of the heat loss there, determines the temperature profile in firing chamber 12. Typically, lamps 50 comprise a tungsten filament enclosed in a sealed, transparent quartz envelope filled with an inert gas; electrical terminals 52 are formed at the ends of the envelope for the application of electrical power to the filament. Typically, end terminal terminals 52 must be kept at a temperature lower than that in firing chamber 12. For this reason, lamps 50 pass through the hole pairs in the sidewalls of firing chamber 12 where they are mounted in fittings 54 so end terminals 52 lie outside firing chamber 12, while the lamp filaments lie principally inside firing chamber 12. As described in application Ser. No. 306,200, electrical power is supplied to groups of lamps 50 by means of a voltage control circuit that maintains the desired temperature profile in firing chamber 12.

Figure 3:
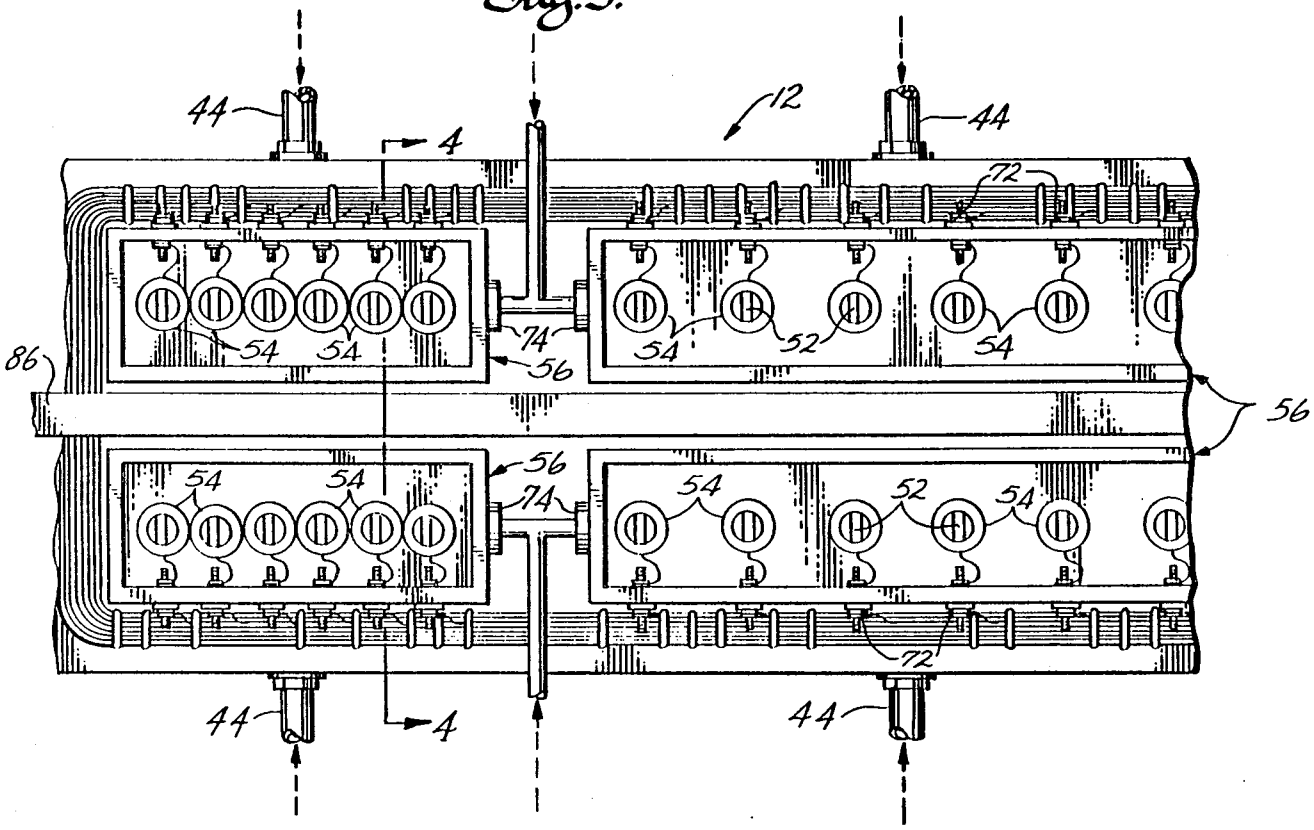
FIG. 3 is a side view of part of the firing chamber of the furnace depicting several of the sealed compartments for enclosing the end terminals of infrared lamps with the hatch removed.
Figure 4:
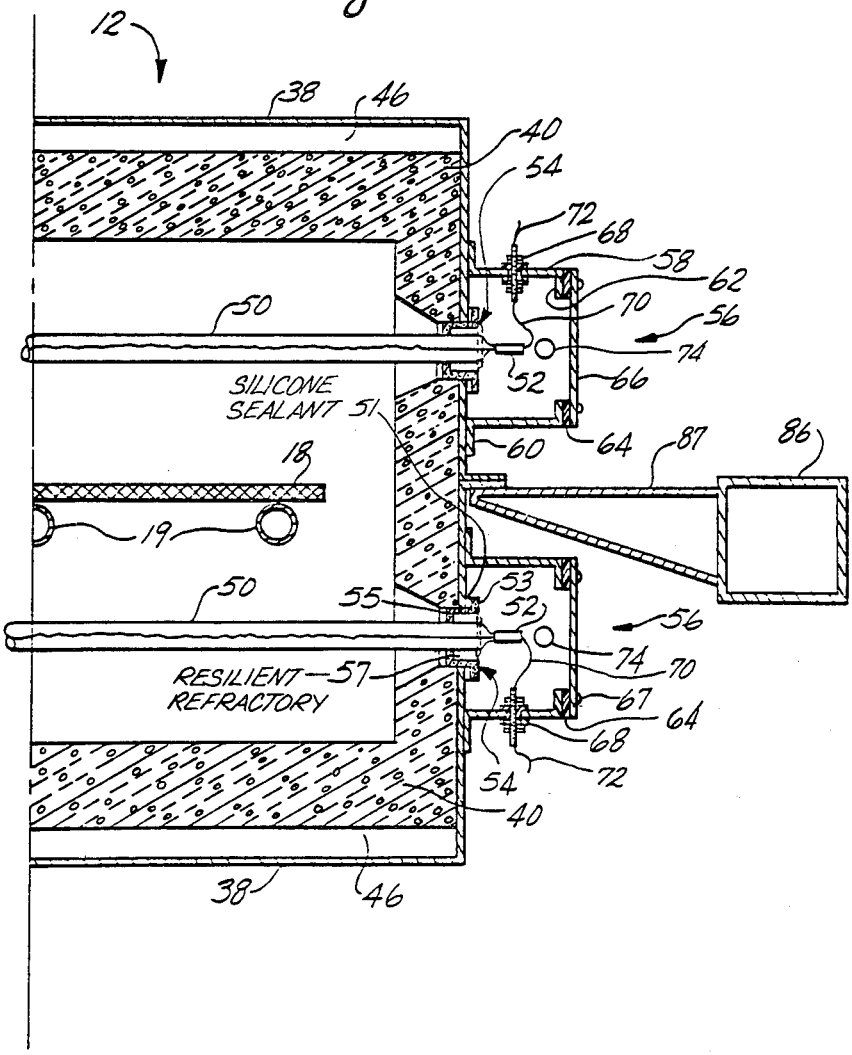
FIG. 4 is an end-sectional view of part of the firing chamber of the furnace taken through the plane designated 4—4 in FIG. 3.

Reference is made to FIGS. 3 and 4 for a description of the manner in which the infrared lamp fittings are sealed from the atmosphere outside the furnace. One of fittings 54 surrounds each end of each of lamps 50, where it passes through the corresponding hole in the sidewalls of firing chamber 12. Fittings 54 are constructed in the manner described in application Ser. No. 306,200. Briefly, fittings 54 each comprise a hollow cylindrical ceramic holder 55 through which the lamp passes. Ceramic holder 55 has an integral shoulder 53. A sealing bead 51 such as a silicone sealant is disposed between cover 38 and shoulder 53 to inhibit gas flow between holder 55 and the sidewalls. A compressed gasket 57 made of resilient refractory material is disposed within ceramic holder 55 as a packing between ceramic holder 55 and lamp 50 to inhibit gas flow between holder 55 and lamp 50. As a result, lamp fittings 54 serve to inhibit loss of heat through the lamp mounting holes and to some extent to inhibit the flow of gas therethrough. Sealed compartments 56 enclose groups of the end terminals of lamps 50. Compartments 56 each comprise an open ended, nonporous rectangular housing 58 having an outwardly extending flange 60 at one end and an inwardly extending flange 62 at the other end. Housing 58 is permanently attached to outer cover 38 by flange 60, so that an atmospheric seal is formed at the interface therebetween. Flange 62 surrounds an access opening in compartments 56 formed by the open end of housing 58. A sealing gasket 64, which could be made for example from neoprene rubber, is secured on flange 62 by an appropriate bonding agent. A removable hatch 66 in the form of a flat plate engages gasket 64 to form an atmospheric seal between hatch 66 and housing 58. Hatch 66 is removably secured to flange 62 by conventional fasteners such as screws 67. Removal of hatch 64 permits access to the interior of compartments 56 to replace lamps 50 in the manner described in application Ser. No. 306,200. Each end terminal 52 has a corresponding connection 68 passing through housing 58, a wire 70 between connection 68 and end terminal 52, and a wire 72 between the source of electrical power (not shown) and connection 68. A nonreactive gas under pressure is supplied to the interior of each compartment 56 through a fitting 74 to cool end terminals 52. End terminals 52 must be maintained at a temperature below about 350° C. The ambient temperature in compartment 56 is normally maintained at about 250° C. by the nonreactive gas, while the temperature in firing chamber 12 is greater than 350° C., typically of the order of 850° to 950° C. The nonreactive gas introduced into compartment 50 leaks through fittings 54 into firing chamber 12; no atmospheric air outside firing chamber 12 reaches the interior thereof through fittings 54 because of the sealing function performed by compartments 56. The furnace lies within a rectangular frame 86 and is secured thereto by a plurality of brackets 87. The nonreactive gas introduced into compartment 56 also cools gasket 64 so materials that establish an effective atmospheric seal such as neoprene rubber may be used therefor.

Figure 5:
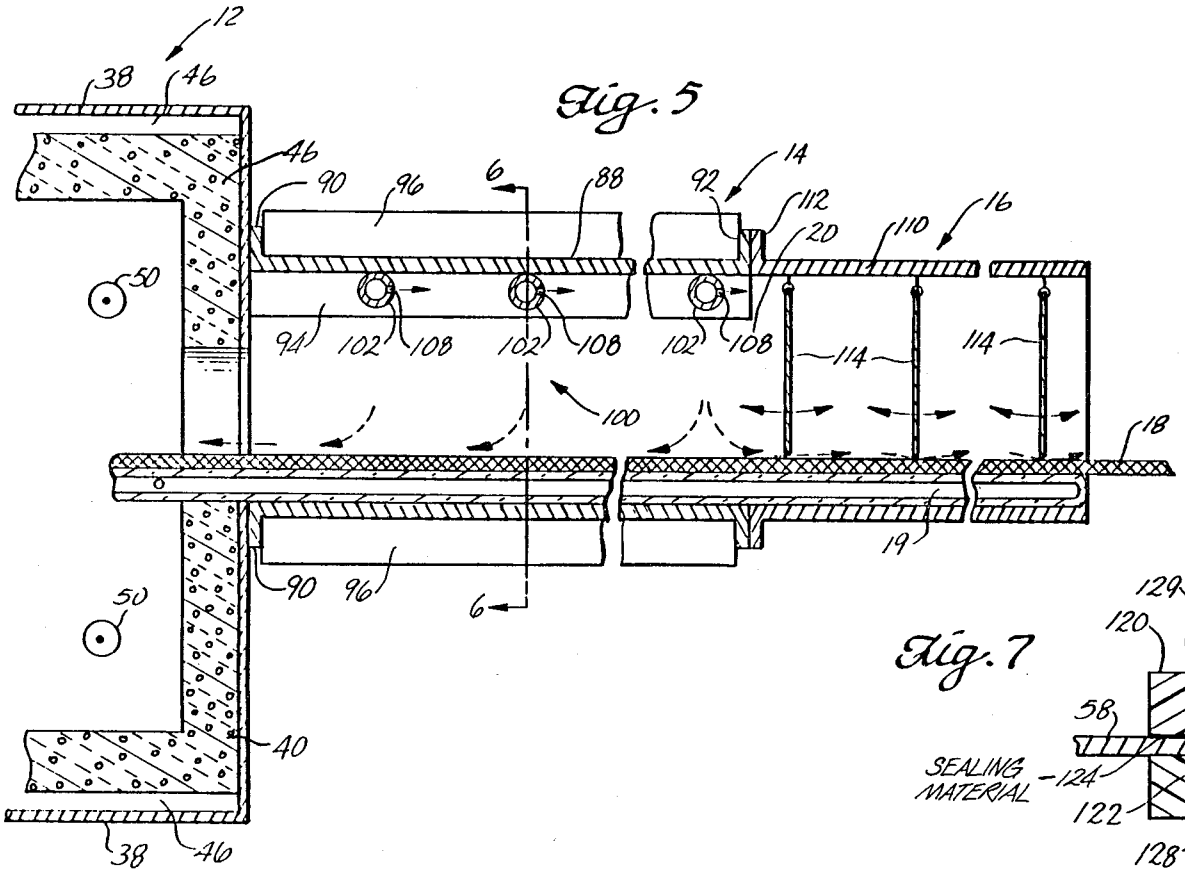
FIG. 5 is a side-sectional view of the cooling chamber and exit chamber of the furnace.
Figure 6:
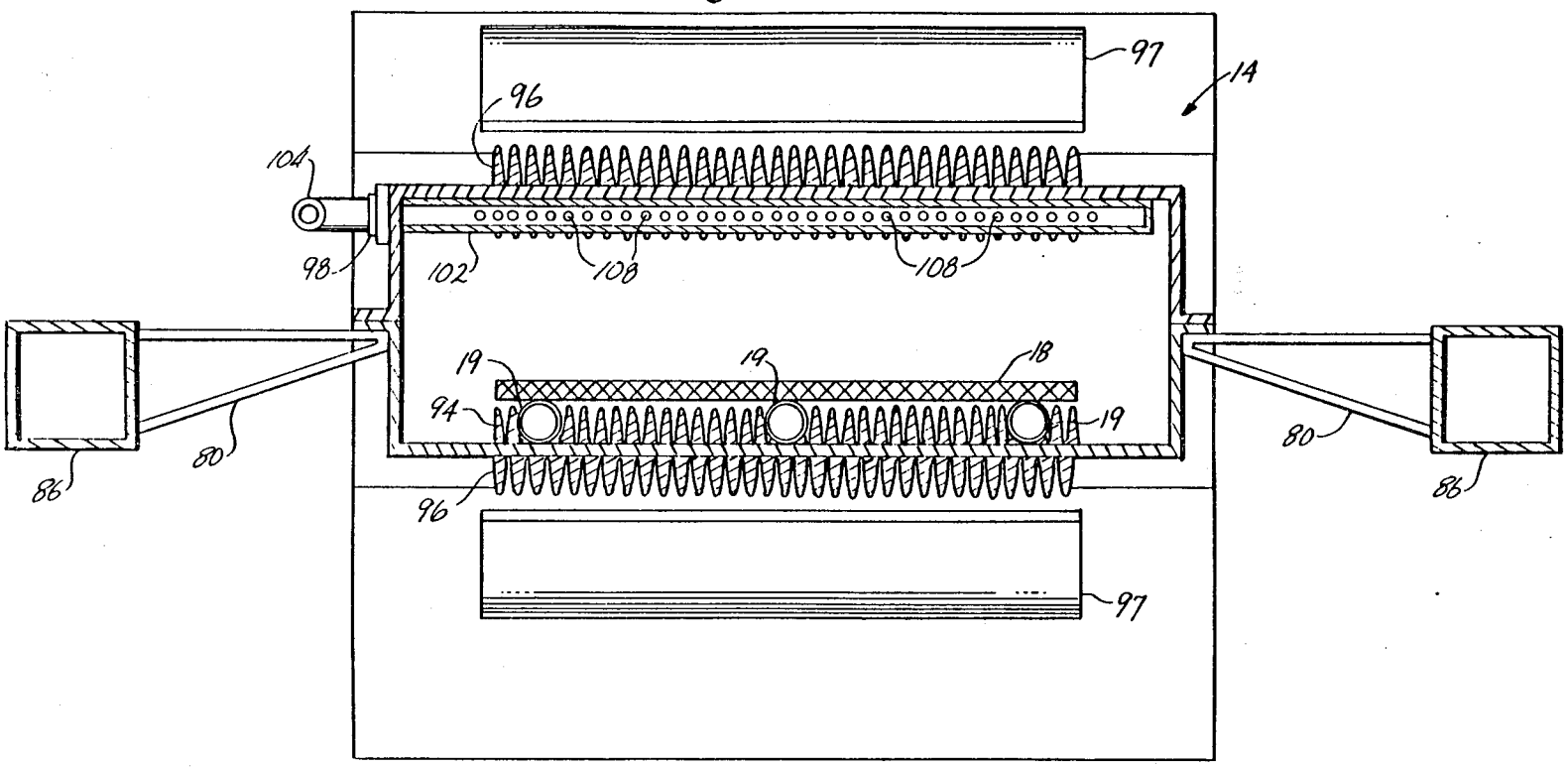
FIG. 6 is an end-sectional view of the cooling chamber taken through the plane designated 6—6 in FIG. 5.

Cooling chamber 14 and exit chamber 16 are shown in FIGS. 5 and 6. Chamber 14 comprises a rectangular, nonporous, open-ended housing 88 having integral sealing flanges, 90 and 92 at its ends. Flange 90 is attached to the end of firing chamber 12 opposite the end to which entrance chamber 10 is attached. Longitudinal cooling fins 94 are formed on the interior top and bottom walls of housing 88. As illustrated in FIG. 6, rods 19 extend slightly above fins 94 on the bottom side of housing 88 to support conveyor belt 18 to the exclusion of these fins. Longitudinal cooling fins 96 are formed on the exterior top and bottom walls of housing 88. If desired, similar cooling fins could be formed on the sidewalls of housing 88. Air blowers 97 are mounted on the top and bottom of housing 88 to cool fins 96. The outlets of blowers 97 are positioned and oriented to blow air through the channels formed by fins 96, thereby improving heat transfer. A nonreactive gas under pressure is introduced into cooling chamber 14 by a rake-like distributing network 100. Network 100 comprises a plurality of pipes 102 that extend transversely across the interior of housing 88 at spaced intervals between its ends and a longitudinally extending manifold pipe 104 that feeds the end of each of pipes 102. Pipes 102 cut across fins 94 at the top of housing 88. Pipe 104 lies outside housing 88. Pipes 102 enter housing 88 at sealed fittings 98. A plurality of holes 108 facing toward the exit are formed in pipe 102. Nonreactive gas at high velocity emanates from holes 108, flowing between fins 94 at the top of housing 88 and over the product on conveyor belt 18 so as to promote convective heat transfer from the product to fins 94. The heat is transferred conductively through housing 88 to fins 96, which are cooled by blowers 97. Thus, effective product cooling takes place in cooling chamber 14.

Exit chamber 16 comprises an open-ended, rectangular, nonporous housing 110 having an integral sealing flange 112 at one end. Exit chamber 16 is attached to the adjacent end of cooling chamber 14 by flanges 92 and 112. Partitions 114 pivotally mounted on the top wall of housing 110 serve to impede the flow of gas to the exterior of the furnace. As illustrated, conveyor belt 18 and rods 19 extend through cooling chamber 14 and exit chamber 16 after leaving firing chamber 12. Rods 19 end at the exit of the furnace while conveyor belt 18 follows a path returning to entrance chamber 10.

Nonreactive gas distributed by network 100 flows down over the product being carried by conveyor belt 18 for cooling purposes. Most of this gas travels into firing chamber 12 towards exhaust duct 32 (FIG. 2); but some of this gas also flows past partitions 114 to the exterior of the furnace. The latter gas flow inhibits the flow of atmospheric air into the furnace through exit chamber 16. A super atmospheric pressure greater than the pressure in firing chamber 12 is established in cooling chamber 14 by the gas introduced by network 100.

The nonreactive gas eminating from network 100 in cooling chamber 14 and layers 40 in firing chamber 12, and to some extent the gas leaking through fittings 54 from compartment 56, flows slowly and continuously across the products being fired in chamber 12 unidirectionally toward entrance chamber 10 to sweep away volatiles given off thereby. These volatiles are drawn out of the furnace through duct 32.

Typically, the nonreactive gas is nitrogen or a non-oxygen-containing gas, at least when base metals such as copper are being fired. The nonporous members, such as covers 22 and 38, tray 26, fins 94 and 96, and housings 58, 88, and 110 are preferably sheet metal. The sealing flanges, such as flanges 42, 60, 90, 92, and 112 are preferably attached by welding, which readily permits an atmospheric seal to be established. The porous elements such as layers 24 and 40 are preferably made from compressed white alumina fiber.

Figure 7:
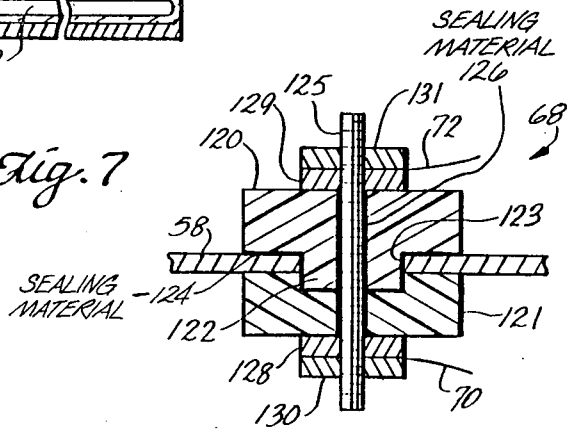
FIG. 7 is a side-sectional view of one of the connections through the compartment of FIGS. 3 and 4.

In FIG. 7, one of connectors 68 is shown in detail. A cylindrical ceramic insulator 120 lies outside compartment 56 and a cylindrical ceramic insulator 121 lies inside compartment 56. One end of insulator 121 has a cylindrical recess. The adjacent end of insulator 120 has a cylindrical protrusion 122 that passes through an opening 123 in housing 58 and fits in the recess at the end of insulator 121. A high temperature sealing material 124 occupies the interface between insulator 120 and the outer surface of housing 58, the interface between insulator 120 and the edge of opening 123, and the interface between insulator 120 and insulator 122. A threaded, electrically conductive rod 125 extends through a passage in insulators 120 and 121 from a point outside compartment 56 to a point inside compartment 56. A high temperature sealing material 126 occupies the interface between the passage and rod 125. Nuts 128 and 129 are threaded onto the exterior end of rod 125 to clamp insulators 120 and 121 to housing 58. A nut 130 is threaded onto the interior end of rod 125 to secure wire 70 thereto and a nut 131 is threaded onto the exterior end of rod 125 to secure wire 72 thereto. The high temperature sealing material 124 and 126 could for example, be a silicone sealant such as General Electric brand RTV, which maintains an atmospheric seal up to a temperature of 450° C. Thus, connector 68 provides an electrical connection between wires 72 and 70 through compartment 56 without permitting entrance of atmospheric air into compartment 56.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, other means could be employed to enclose the end terminals of the lamps.

What is claimed is:

1. An infrared furnace comprising:

an insulated firing chamber with oppositely disposed sidewalls having a plurality of aligned pairs of holes and oppositely disposed top and bottom walls, the sidewalls and top and bottom walls defining a horizontal, elongated passage from an entrance to an exit;

a product conveyor extending through the passage from the entrance to the exit;

a plurality of infrared lamps disposed in the chamber, the lamps having end terminals passing through the respective hole pairs to the exterior of the chamber;

first means for introducing a non-reactive gas to the passage;

compartment means enclosing the end terminals of the lamps on the exterior of the chamber, the compartment means being sealed against intrusion from the atmosphere outside the furnace; and second means for introducing to the compartment means a non-reactive gas under more pressure than in the passage to induce flow of said gas through the holes into the firing chamber.

2. The furnace of claim 1, additionally comprising heat insulative material filling the space in the hole pairs between the lamps and the firing chamber.

3. The furnace of claim 2, in which the compartment means includes an opening making the ends of the lamps accessible from the exterior of the furnace, a gasket around the opening, and a removable hatch engaging the gasket to seal the hatch when in place, and means for fastening the hatch to the housing.

4. The furnace of claim 3, in which the first and second introducing means each introduces a non-oxygen-containing gas.

5. The furnace of claim 4, in which the first and second introducing means each introduces nitrogen.

6. The furnace of claim 5, additionally comprising means for energizing the lamps to maintain temperature in the firing chamber of the order of 850° to 950° C. and the introducing means introduces sufficient gas to the compartment means to maintain the temperature therein at a temperature below 650° C.

7. The furnace of claim 1, additionally comprising a hollow, cylindrical ceramic holder within each hole around the lamp passing therethrough and a compressed gasket of resilient refractory material disposed in the hollow of the holder around the lamp.

8. The furnace of claim 7, in which each holder has an integral shoulder abutting the sidewall of the firing chamber and a sealant disposed between the sidewall and the shoulder.

9. The furnace of claim 1, additionally comprising a cooling chamber connected to the exit of the firing chamber so the conveyor passes through the cooling chamber and third means for introducing into the cooling chamber a non-reactive gas at a pressure higher than the pressure in the firing chamber, thereby inducing unidirectional, continuous flow of the non-reactive gas from the cooling chamber to the firing chamber.

10. The furnace of claim 1, additionally comprising an entrance chamber connected to the entrance of the firing chamber so the conveyor passes through the entrance chamber and an exhaust duct in the entrance chamber drawing the non-reactive gas from the firing chamber out of the entrance chamber.

11. The furnace of claim 10, additionally comprising a tray extending over the conveyor in the entrance chamber so as to form a venting passage from the entrance of the firing chamber to the exhaust duct.

12. The furnace of claim 11, in which the entrance chamber has a plurality of partitions attached to the tray to inhibit flow of the non-reactive gas from the firing chamber to the exterior of the furnace.

13. The furnace of claim 12, additionally comprising an exit chamber connected to the cooling chamber so the conveyor passes through the exit chamber and a plurality of vertically arranged partitions in the exit chamber to inhibit flow of the non-reactive gas from the cooling chamber to the exterior of the furnace.

* * * * *